US012392505B2

(12) United States Patent
Zhao et al.

(10) Patent No.: US 12,392,505 B2
(45) Date of Patent: Aug. 19, 2025

(54) AIR CONDITIONER

(71) Applicant: QINGDAO HISENSE HITACHI AIR-CONDITIONING SYSTEMS CO., LTD., Shandong (CN)

(72) Inventors: Dongfang Zhao, Shandong (CN); Fali Cao, Shandong (CN); Xiaoyu Li, Shandong (CN); Lihua Shi, Shandong (CN); Xiaolei Liu, Shandong (CN); Yajun Li, Shandong (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 175 days.

(21) Appl. No.: 18/485,541

(22) Filed: Oct. 12, 2023

(65) Prior Publication Data

US 2024/0060659 A1 Feb. 22, 2024

Related U.S. Application Data

(63) Continuation of application No. PCT/CN2022/081815, filed on Mar. 18, 2022.

(30) Foreign Application Priority Data

Jul. 26, 2021 (CN) ..... 202110845573.4
Jul. 26, 2021 (CN) ..... 202110845581.9

(51) Int. Cl.
*F24F 1/0063* (2019.01)
*F24F 1/0068* (2019.01)
(Continued)

(52) U.S. Cl.
CPC ..... *F24F 1/0063* (2019.02); *F24F 1/0068* (2019.02); *F25B 39/00* (2013.01);
(Continued)

(58) Field of Classification Search
CPC ..... F24F 1/0063; F24F 1/0068; F28D 1/0476; F28D 1/05391; F28F 1/128; F28F 1/325;
(Continued)

(56) References Cited

U.S. PATENT DOCUMENTS

2016/0223265 A1 8/2016 Jindou et al.
2016/0327343 A1 11/2016 Hwang et al.
(Continued)

FOREIGN PATENT DOCUMENTS

CN 101619912 A 1/2010
CN 201680652 U 12/2010
(Continued)

OTHER PUBLICATIONS

International Search Report and Written Opinion dated Jun. 9, 2022 in corresponding International Application No. PCT/CN2022/081815, translated, 19 pages.
(Continued)

*Primary Examiner* — Joseph F Trpisovsky
(74) *Attorney, Agent, or Firm* — MH2 TECHNOLOGY LAW GROUP LLP

(57) ABSTRACT

An air conditioner includes a compressor and a heat exchanger. The heat exchanger includes a first heat exchanger, a second heat exchanger, a plurality of connectors, at least one first header, a second header, and a main air pipe assembly. A plurality of flat pipes in the second heat exchanger correspond to a plurality of flat pipes in the first heat exchanger. The plurality of connectors are arranged corresponding to the plurality of flat pipes in the first heat exchanger. The at least one first header is connected to first ends of the plurality of flat pipes in the first heat exchanger. The second header is connected to first ends of the plurality
(Continued)

of flat pipes in the second heat exchanger. The main air pipe assembly makes the second header communicated with the compressor.

18 Claims, 18 Drawing Sheets

(51) Int. Cl.

| | |
|---|---|
| ***F25B 39/00*** | (2006.01) |
| ***F25B 39/02*** | (2006.01) |
| *F28D 1/047* | (2006.01) |
| *F28D 1/053* | (2006.01) |
| *F28F 9/02* | (2006.01) |

(52) U.S. Cl.
CPC ..... *F25B 39/028* (2013.01); *F28D 1/0476* (2013.01); *F28D 1/05391* (2013.01); *F28F 9/0275* (2013.01)

(58) Field of Classification Search
CPC ..... F28F 9/0275; F25B 13/00; F25B 39/00; F25B 39/028
See application file for complete search history.

(56) References Cited

U.S. PATENT DOCUMENTS

| | | | |
|---|---|---|---|
| 2018/0010857 | A1 | 1/2018 | Yang et al. |
| 2019/0234626 | A1 | 8/2019 | Onaka et al. |
| 2022/0243988 | A1 | 8/2022 | Yamada et al. |

FOREIGN PATENT DOCUMENTS

| | | | | | |
|---|---|---|---|---|---|
| CN | 202166234 | U | | 3/2012 | |
| CN | 204085299 | U | | 1/2015 | |
| CN | 104764255 | A | | 7/2015 | |
| CN | 104764256 | A | | 7/2015 | |
| CN | 205718555 | U | | 11/2016 | |
| CN | 108088121 | A | | 5/2018 | |
| CN | 108797048 | A | | 11/2018 | |
| CN | 109990627 | A | | 7/2019 | |
| CN | 211695162 | U | | 10/2020 | |
| CN | 211926198 | U | | 11/2020 | |
| CN | 112413932 | A | | 2/2021 | |
| CN | 213178905 | U | | 5/2021 | |
| CN | 214010051 | U | | 8/2021 | |
| CN | 113587250 | A | | 11/2021 | |
| CN | 113587251 | A | | 11/2021 | |
| JP | H0468297 | A | | 3/1992 | |
| JP | 2013002688 | A | | 1/2013 | |
| WO | WO-2016174830 | A1 | * | 11/2016 | ..... F24F 5/00 |
| WO | 2018040037 | A1 | | 3/2018 | |
| WO | 2020230737 | A1 | | 11/2020 | |

OTHER PUBLICATIONS

Chinese First Office Action dated May 31, 2022 in corresponding Chinese Application No. 202110845573.4, translated, 13 pages.
Chinese Second Office Action dated Oct. 9, 2022 in corresponding Chinese Application No. 202110845573.4, translated, 10 pages.
Chinese Decision of Rejection dated Feb. 3, 2023 in corresponding Chinese Application No. 202110845573.4, translated, 11 pages.
Chinese First Office Action dated May 7, 2022 in corresponding Chinese Application No. 202110845581.9, translated, 18 pages.
Chinese Notification to Grant Patent Right for Invention dated Oct. 10, 2022 in corresponding Chinese Application No. 202110845581.9, translated, 9 pages.

* cited by examiner

AIR CONDITIONER

CROSS-REFERENCE TO RELATED APPLICATIONS

This application is a continuation application of International Patent Application No. PCT/CN2022/081815, filed on Mar. 18, 2022, which claims priority to Chinese Patent Application No. 202110845573.4, filed on Jul. 26, 2021, and Chinese Patent Application No. 202110845581.9, filed on Jul. 26, 2021, which are incorporated herein by reference in their entireties.

TECHNICAL FIELD

The present disclosure relates to the field of air conditioning technologies, and in particular, to an air conditioner.

BACKGROUND

The air conditioner is a commonly used family household appliance, and may adjust temperature and humidity of indoor air. The air conditioner includes a heat exchanger that exchanges heat with air, and the heat exchanger is an important component of the air conditioner and may be used as an evaporator or a condenser.

Generally, the heat exchanger may adopt a finned heat exchanger, and the finned heat exchanger includes fins, a heat exchange pipe group passing through the fins, and the like. The heat exchange performance of the heat exchanger is directly related to the connection mode between a plurality of heat exchange pipes in the heat exchange pipe group.

SUMMARY

An air conditioner is provided. The air conditioner includes a compressor and a heat exchanger. The heat exchanger includes a first heat exchanger, a second heat exchanger, a plurality of connectors, at least one first header, a second header, and a main air pipe assembly. The first heat exchanger includes a plurality of flat pipes, and the second heat exchanger includes another plurality of flat pipes. The another plurality of flat pipes in the second heat exchanger correspond to the plurality of flat pipes in the first heat exchanger. Each flat pipe in both the another plurality of flat pipes in the second heat exchanger and the plurality of flat pipes in the first heat exchanger includes a first straight pipe section, a second straight pipe section, and a bent section. The second straight pipe section is parallel to the first straight pipe section. The bent section is located on a same side of the first straight pipe section and the second straight pipe section and connected to an end of the first straight pipe section and an end of the second straight pipe section. Another end of the first straight pipe section is a first end of the flat pipe, and another end of the second straight pipe section is a second end of the flat pipe. The plurality of connectors are arranged corresponding to the plurality of flat pipes in the first heat exchanger, and any connector in the plurality of connectors is configured to connect a second end of a flat pipe in the first heat exchanger to a second end of a flat pipe in the second heat exchanger. The at least one first header is connected to first ends of the plurality of flat pipes in the first heat exchanger. The second header is connected to first ends of the another plurality of flat pipes in the second heat exchanger. The main air pipe assembly includes a main air pipe, a plurality of branch air pipes, and a connecting pipe. An end of the main air pipe is closed. The plurality of branch air pipes are arranged at intervals in an extending direction of the main air pipe. An end of any branch air pipe in the plurality of branch air pipes communicates with the main air pipe, and another end thereof communicates with the second header. Another end of the main air pipe is connected to an end of the connecting pipe, and another end of the connecting pipe is connected to the compressor.

BRIEF DESCRIPTION OF THE DRAWINGS

In order to describe technical solutions of the present disclosure more clearly, accompanying drawings to be used in the description of some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams and are not limitations on an actual size of a product, an actual process of a method, and an actual timing of a signal to which the embodiments of the present disclosure relate.

DETAILED DESCRIPTION

Figure 1:
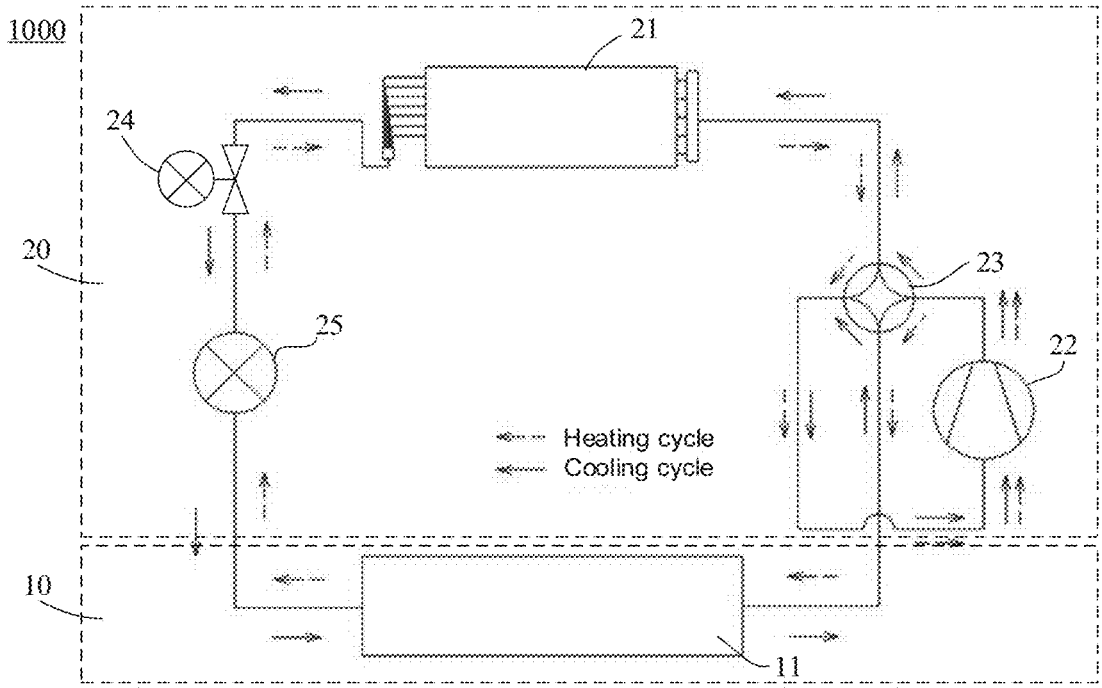
FIG. 1 is a schematic diagram of an air conditioner, in accordance with some embodiments.

Some embodiments of the present disclosure will be described clearly and completely with reference to the accompanying drawings below. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as open and inclusive, i.e., "including, but not limited to." In the description of the specification, the terms such as "one embodiment," "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics described herein may be included in any one or more embodiments or examples in any suitable manner.

Hereinafter, the terms such as "first" and "second" are used for descriptive purposes only, and are not to be construed as indicating or implying the relative importance or implicitly indicating the number of indicated technical features. Thus, features defined with "first" or "second" may explicitly or implicitly include one or more of the features. In the description of the embodiments of the present disclosure, the term "a plurality of" or "the plurality of" means two or more unless otherwise specified.

In the description of some embodiments, the expressions "coupled" and "connected" and derivatives thereof may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other but still cooperate or interact with each other. The embodiments disclosed herein are not necessarily limited to the content herein.

The phrase "at least one of A, B and C" has a same meaning as the phrase "at least one of A, B, or C," and they both include the following combinations of A, B, and C: only A, only B, only C, a combination of A and B, a combination of A and C, a combination of B and C, and a combination of A, B, and C.

The phrase "A and/or B" includes following three combinations: only A, only B, and a combination of A and B.

The phrase "applicable to" or "configured to" as used herein indicates an open and inclusive expression, which does not exclude apparatuses that are applicable to or configured to perform additional tasks or steps.

The term "about," "substantially," and "approximately" as used herein includes a stated value and an average value within an acceptable range of deviation of a particular value. The acceptable range of deviation is determined by a person of ordinary skill in the art in consideration of measurement in question and errors associated with measurement of a particular quantity (i.e., limitations of a measurement system).

The term such as "parallel," "perpendicular," or "equal" as used herein includes a stated condition and a condition similar to the stated condition. A range of the similar condition is within an acceptable range of deviation. The acceptable range of deviation is determined by a person of ordinary skill in the art in view of measurement in question and errors associated with the measurement of a particular quantity (i.e., limitations of the measurement system). For example, the term "parallel" includes absolute parallelism and approximate parallelism, and an acceptable range of deviation of the approximate parallelism may be a deviation within 5°; the term "perpendicular" includes absolute perpendicularity and approximate perpendicularity, and an acceptable range of deviation of the approximate perpendicularity may also be a deviation within 5°: and the term "equal" includes absolute equality and approximate equality, and an acceptable range of deviation of the approximate equality may be a difference between two equals being less than or equal to 5% of either of the two equals.

FIG. 1 is a schematic diagram of an air conditioner in accordance with some embodiments.

An air conditioner is provided. As shown in FIG. 1, the air conditioner 1000 includes an air conditioner indoor unit 10 and an air conditioner outdoor unit 20. The air conditioner indoor unit 10 and the air conditioner outdoor unit 20 are connected by a pipe to convey a refrigerant.

The air conditioner indoor unit 10 includes an indoor heat exchanger 11.

The air conditioner outdoor unit 20 includes an outdoor heat exchanger 21, a compressor 22, a four-way valve 23, an expansion valve 24, and a throttle mechanism 25. In some embodiments, the expansion valve 24 may also be provided in the air conditioner indoor unit 10. The throttle mechanism 25 may be a throttle valve or a capillary.

The compressor 22, the outdoor heat exchanger 21, the expansion valve 24, and the indoor heat exchanger 11 that are connected in sequence form a refrigerant loop.

The refrigerant circulates in the refrigerant loop and exchanges heat with air through the outdoor heat exchanger 21 and the indoor heat exchanger 11, so as to implement a cooling mode or a heating mode of the air conditioner 1000.

The compressor 22 is configured to compress the refrigerant, so that a low-pressure refrigerant is compressed to be a high-pressure refrigerant.

The outdoor heat exchanger 21 is configured to perform heat-exchange between outdoor air and the refrigerant conveyed in the outdoor heat exchanger 21. For example, the outdoor heat exchanger 21 operates as a condenser in a cooling mode of the air conditioner 1000, so that the refrigerant compressed by the compressor 22 dissipates heat into the outdoor air through the outdoor heat exchanger 21 to be condensed; and the outdoor heat exchanger 21 operates as an evaporator in a heating mode of the air conditioner 1000, so that the decompressed refrigerant absorbs heat from the outdoor air through the outdoor heat exchanger 21 to be evaporated.

Generally, the outdoor heat exchanger 21 further includes heat exchange fins, so as to expand a contact area between the outdoor air and the refrigerant conveyed in the outdoor heat exchanger 21, thereby improving heat exchange efficiency between the outdoor air and the refrigerant.

The expansion valve 24 is connected between the outdoor heat exchanger 21 and the indoor heat exchanger 11. A pressure of the refrigerant flowing between the outdoor heat exchanger 21 and the indoor heat exchanger 11 is adjusted by an opening degree of the expansion valve 24, so as to adjust the flow of the refrigerant flowing between the outdoor heat exchanger 21 and the indoor heat exchanger 11. The flow and the pressure of the refrigerant flowing between the outdoor heat exchanger 21 and the indoor heat exchanger 11 will affect the heat exchange performance of the outdoor heat exchanger 21 and the indoor heat exchanger 11. The expansion valve 24 may be an electronic valve. The opening degree of the expansion valve 24 is adjustable, and thus the flow and the pressure of the refrigerant flowing through the expansion valve 24 may be controlled.

The four-way valve 23 is connected in the refrigerant loop and is configured to switch a flow direction of the refrigerant in the refrigerant loop, so as to cause the air conditioner 1000 to perform the cooling mode or the heating mode.

The throttle mechanism 25 is connected between the expansion valve 24 and the indoor heat exchanger 11. In a case where the air conditioner 1000 operates in the cooling mode, the throttle mechanism 25 is configured to throttle a supercooled liquid refrigerant flowing out of the outdoor heat exchanger 21 into a gas-liquid two-phase refrigerant with low temperature and low pressure, and the flow direction of the refrigerant is shown by solid arrows in FIG. 1. In a case where the air conditioner 1000 operates in the heating mode, the throttle mechanism 25 is configured to throttle a supercooled liquid refrigerant flowing out of the indoor heat exchanger 11 into a gas-liquid two-phase refrigerant with low temperature and low pressure, and the flow direction of the refrigerant is shown by dashed arrows in FIG. 1.

The indoor heat exchanger 11 is configured to perform heat-exchange between indoor air and the refrigerant conveyed in the indoor heat exchanger 11. For example, the indoor heat exchanger 11 operates as an evaporator in a cooling mode of the air conditioner 1000, so that the refrigerant, which has dissipated heat through the outdoor heat exchanger 21, absorbs heat from the indoor air through the indoor heat exchanger 11 to be evaporated: and the indoor heat exchanger 11 operates as a condenser in a heating mode of the air conditioner 1000, so that the refrigerant, which has absorbed heat through the outdoor heat exchanger 21, dissipates heat into the indoor air through the indoor heat exchanger 11 to be condensed.

Generally, the indoor heat exchanger 11 further includes heat exchange fins, so as to expand a contact area between the indoor air and the refrigerant conveyed in the indoor heat exchanger 11, thereby improving heat exchange efficiency between the indoor air and the refrigerant.

Operation manners of the cooling mode and the heating mode of the air conditioner 1000 will be described below with reference to FIG. 1.

As shown in FIG. 1, in a case where the air conditioner 1000 operates in the cooling mode, the refrigerant is compressed by the compressor 22 to become a superheated gaseous refrigerant with high-temperature and high-pressure, and the superheated gaseous refrigerant is discharged into the outdoor heat exchanger 21 for condensation. In this case, since the refrigerant is in the superheated gas phase, there is no flow-dividing problem, and the refrigerant may be evenly distributed when entering the outdoor heat exchanger 21. In the outdoor heat exchanger 21, the superheated gaseous refrigerant is cooled into a supercooled liquid refrigerant, and the supercooled liquid refrigerant flows into the throttle mechanism 25. The throttle mechanism 25 may throttle the supercooled liquid refrigerant into a gas-liquid two-phase refrigerant with low temperature and low pressure, and the gas-liquid two-phase refrigerant with low temperature and low pressure flows into the indoor heat exchanger 11 for evaporation and heat absorption. In the indoor heat exchanger 11, the refrigerant is evaporated into superheated gas again and returns to a suction end of the compressor 22, so as to accomplish a cycle. In the case where the air conditioner 1000 operates in the cooling mode, the flow direction of the refrigerant is shown by the solid arrows in FIG. 1.

As shown in FIG. 1, in a case where the air conditioner 1000 operates in the heating mode, a gaseous refrigerant with high-temperature and high-pressure passes through the four-way valve 23 and is directly discharged into the indoor heat exchanger 11 for heating. After the refrigerant is cooled to a supercooled liquid refrigerant in the indoor heat exchanger 11, the supercooled liquid refrigerant flows into the throttle mechanism 25 and is throttled by the throttle mechanism 25 to become gas-liquid two-phase refrigerant with low temperature and low pressure. The gas-liquid two-phase refrigerant with low temperature and low pressure flows into the outdoor heat exchanger 21 for evaporation and heat absorption. In a case where the gas-liquid two-phase refrigerant with low temperature and low pressure is in a large space or in a case where the flow rate thereof decreases, in order to avoid uneven flow-dividing caused by gas-liquid phase separation, a liquid separation mechanism may be provided on a side of a liquid inlet of the outdoor heat exchanger 21 (such as a first header 200 in the following text), so as to ensure substantially the same flow rates of the refrigerants entering all heat exchange pipes (such as flat pipes 100 in the following text) of the outdoor heat exchanger 21, thereby maximizing the effectiveness of the heat exchanger.

In the case where the air conditioner 1000 operates in the heating mode, the flow direction of the refrigerant is shown by the dashed arrows in FIG. 1.

Figure 2:
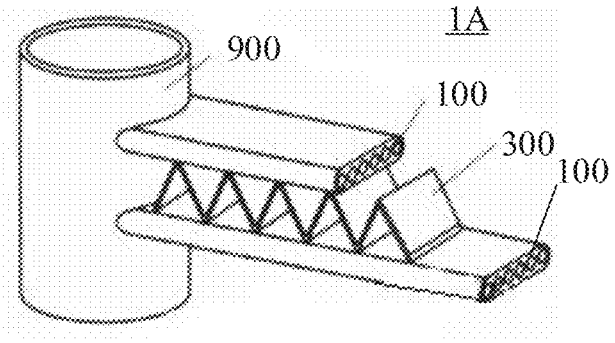
FIG. 2 is a three-dimensional view of a first micro-channel heat exchanger, in accordance with some embodiments.

FIG. 2 is a three-dimensional view of a first micro-channel heat exchanger in accordance with some embodiments.

Some embodiments of the present disclosure provide an air conditioner 1000, which includes a first micro-channel heat exchanger 1A shown in FIG. 2. For example, the first micro-channel heat exchanger 1A is a micro-channel parallel flow heat exchanger. The first micro-channel heat exchanger 1A includes a header 900, flat pipes 100, and fins 300. The first micro-channel heat exchanger 1A includes the flat pipes 100 arranged in an axial direction of the header 900, and the flat pipes 100 are connected through the header 900. The fins 300 are disposed between two adjacent flat pipes 100, and the fins 300 are configured to enhance a heat exchange effect between the first micro-channel heat exchanger 1A and air.

For example, the first micro-channel heat exchanger 1A is an all-aluminum heat exchanger.

In some embodiments, in order to improve heat exchange efficiency, the air conditioner 1000 may include a multi-row of micro-channel heat exchanger. The multi-row micro-channel heat exchanger includes a plurality of micro-channel heat exchangers (e.g., the first micro-channel heat exchanger 1A), and the plurality of micro-channel heat exchangers are arranged in a flow direction of air (a Q direction shown in FIG. 3). For example, the plurality of micro-channel heat exchangers included in the multi-row micro-channel heat exchanger are arranged in the flow direction of air, so that the multi-row micro-channel heat exchanger includes a plurality of rows of flat pipes 100 arranged at intervals in the axial direction of the header 900.

Figure 3:
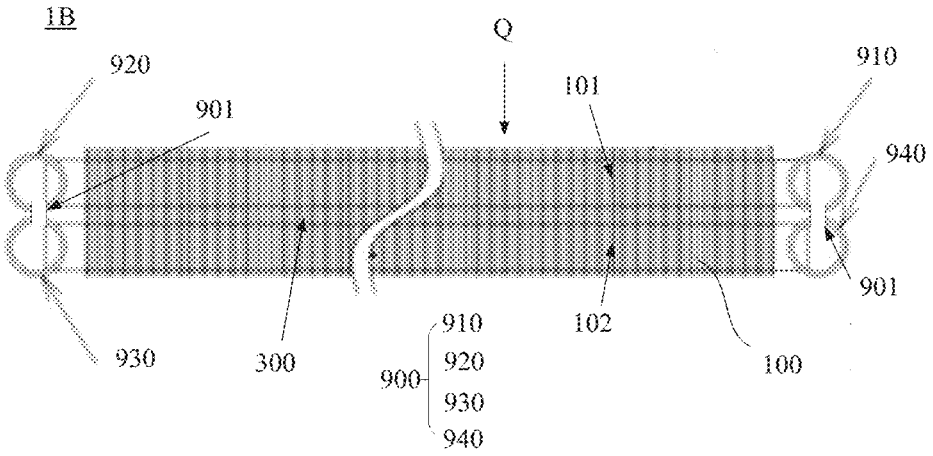
FIG. 3 is a structural diagram of a multi-row micro-channel heat exchanger, in accordance with some embodiments.

FIG. 3 is a structural diagram of a multi-row micro-channel heat exchanger in accordance with some embodiments.

For example, as shown in FIG. 3, the multi-row micro-channel heat exchanger is a second micro-channel heat exchanger 1B, such as a double-row micro-channel heat exchanger. The second micro-channel heat exchanger 1B includes a first header 910, a second header 920, a third header 930, a fourth header 940, fins 300, a second flat pipe 102, and a first flat pipe 101. For example, the first flat pipe 101 is a flat pipe located in an outer row (i.e., an outer-row flat pipe), and the second flat pipe 102 is a flat pipe located in an inner row (i.e., an inner-row flat pipe). Both ends of the first flat pipe 101 communicate with the first header 910 and the second header 920. Both ends of the second flat pipe 102 communicate with the third header 930 and the fourth header 940.

The first flat pipe 101 and the second flat pipe 102 are connected together by the same group of fins 300, so that the heat exchange effect between the second micro-channel heat exchanger 1B and air may be enhanced.

It will be noted that, in the second micro-channel heat exchanger 11, the refrigerant will flow across rows. For example, in the case where the air conditioner 1000 operates in the heating mode, the refrigerant flows into a plurality of flat pipes 100 (e.g., 6 flat pipes) in the first flat pipe 101 through the first header 910, and enters the second header 920 from the plurality of flat pipes 100, and then flows out from the second header 920. According to different flow paths, the refrigerant, after flowing out of the second header 920, will have two flow ways.

One flow way is that the refrigerant still flows in the first flat pipe 101. For example, the refrigerant flows into the flat pipes 100 from the second header 920 and returns to the first header 910 from the flat pipes 100. The refrigerant may enter the fourth header 940 from the first header 910. The flow manner of the refrigerant in the fourth header 940 is similar to that of the refrigerant in the first header 910, and details will not be repeated here.

Another flow way is that the refrigerant flows from the second header 920 to the third header 930. In this case, the second micro-channel heat exchanger 1B further includes connecting pipes 901, and the connecting pipe 901 is configured to allow the refrigerant to flow across rows.

Figure 4:
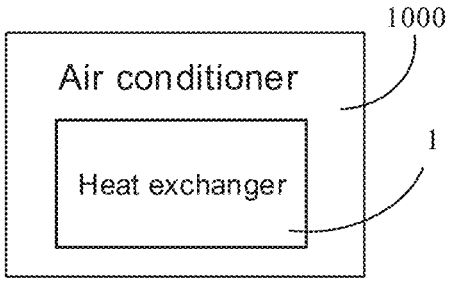
FIG. 4 is a block diagram of an air conditioner, in accordance with some embodiments.
Figure 5:
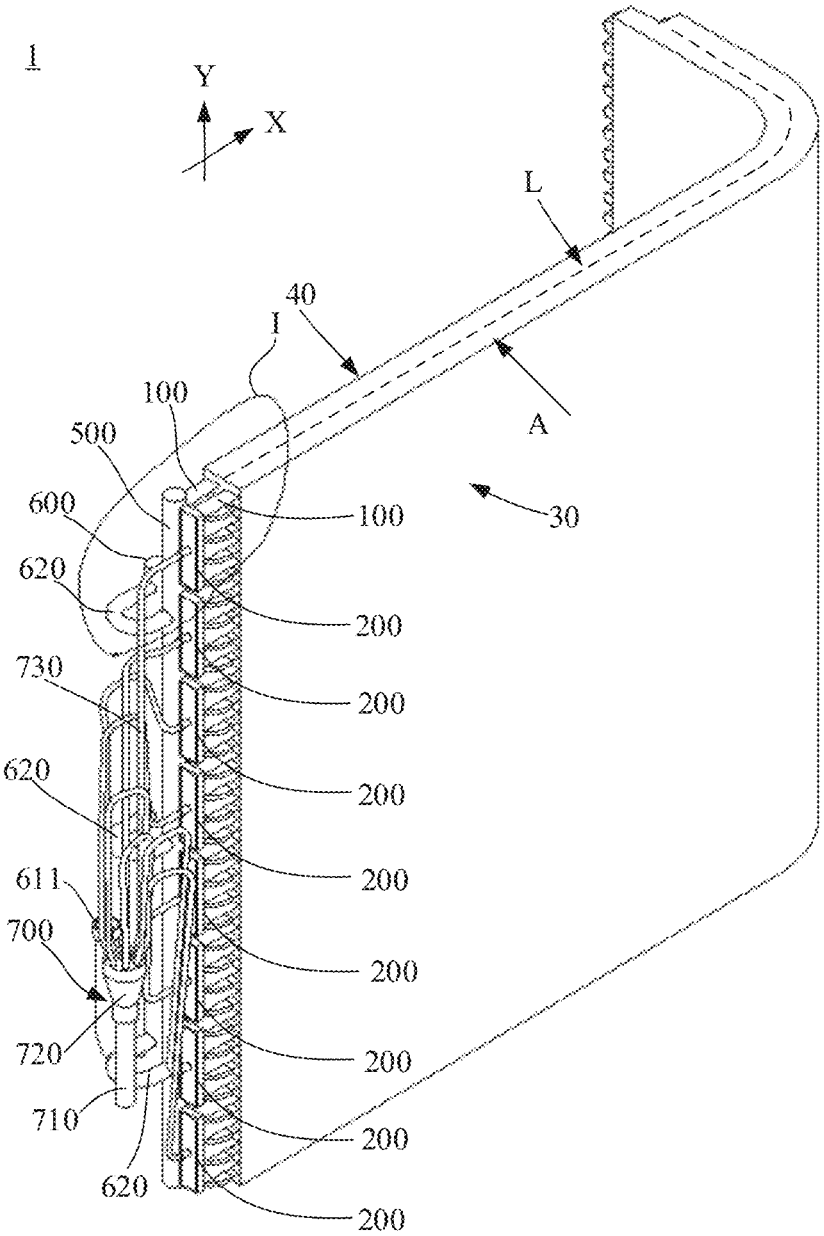
FIG. 5 is a three-dimensional view of a heat exchanger, in accordance with some embodiments.

FIG. 4 is a block diagram of an air conditioner in accordance with some embodiments. FIG. 5 is a three-dimensional view of a heat exchanger in accordance with some embodiments.

Some embodiments of the present disclosure provide another air conditioner 1000. As shown in FIG. 4, the air conditioner 1000 includes a heat exchanger 1.

In some embodiments, the heat exchanger 1 is a multi-flat-pipe parallel flow heat exchanger.

As shown in FIG. 5, the heat exchanger 1 includes a first heat exchanger 30 and a second heat exchanger 40 that are arranged in the flow direction of air (a direction A shown in FIG. 5). For example, the first heat exchanger 30 is an outer-row heat exchanger, and the second heat exchanger 40 is an inner-row heat exchanger. In FIG. 5, a dotted line L is a dividing line between the first heat exchanger 30 and the second heat exchanger 40.

The first heat exchanger 30 and the second heat exchanger 40 each include a plurality of flat pipes 100. The plurality of flat pipes 100 in the first heat exchanger 30 correspond to the plurality of flat pipes 100 in the second heat exchanger 40, respectively. The first heat exchanger 30 and the second heat exchanger 40 each further include fins 300 (referring to FIG. 7).

The plurality of flat pipes 100 in the first heat exchanger 30 and the plurality of flat pipes 100 in the second heat exchanger 40 are arranged, in their respective rows, at intervals up and down in a height direction of the heat exchanger 1 (i.e., a Y direction in FIG. 5). That is, the plurality of flat pipes 100 in the first heat exchanger 30 are arranged at intervals up and down in a height direction of the first heat exchanger 30 (i.e., the Y direction in FIG. 5), and the plurality of flat pipes 100 in the second heat exchanger 40 are arranged at intervals up and down in a height direction of the second heat exchanger 40 (i.e., the Y direction in FIG. 5). A distance between two vertically adjacent flat pipes 100 is in a range of 10 mm to 18 mm (e.g., 10 mm, 13 mm, 15 mm or 18 mm). The flat pipe 100 includes a plurality of micro-channels configured to allow the refrigerant to flow.

A part of the flat pipe 100 is inserted in the fins 300. The flow direction of air flowing through the fins 300 (the direction A shown in FIG. 5) and a flow direction of the refrigerant in the flat pipe 100 (an X direction shown in FIG. 5) are perpendicular to each other. The heat or cooling released by the refrigerant in the flat pipe 100 is taken away by the fins 300 through heat dissipation and air flowing, which may enhance the heat exchange between the heat exchanger 1 and the air.

In some embodiments, the flat pipe 100 adopts porous micro-channel aluminum alloy, and the fin 300 is made of aluminum alloy with a brazing composite layer on the surface, which may be light in weight and high in heat exchange efficiency.

Figure 6:
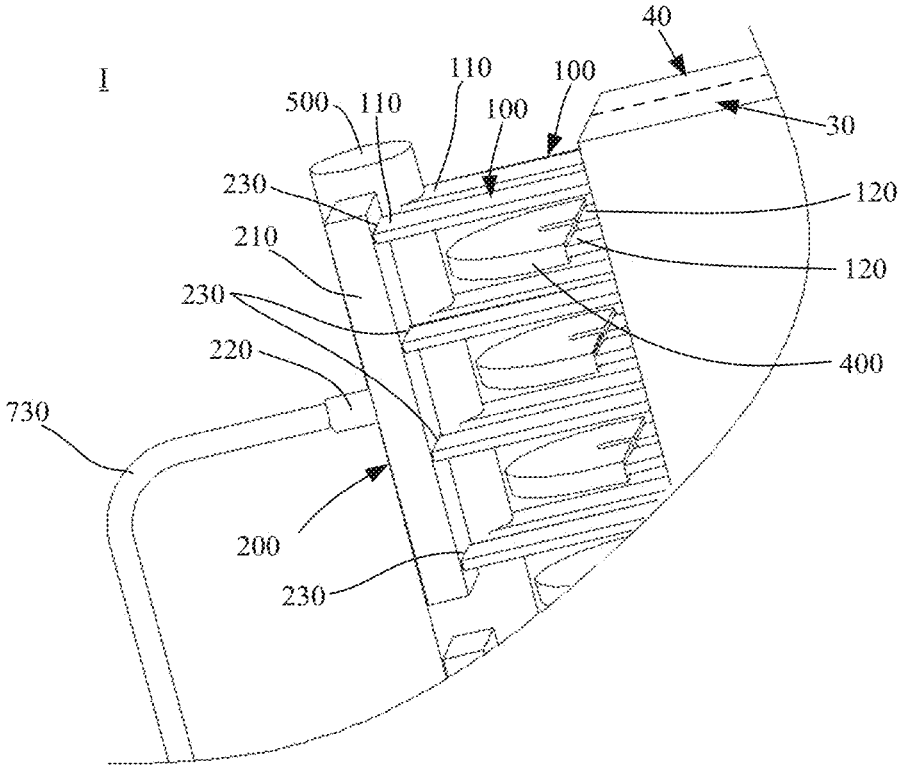
FIG. 6 is a partial enlarged view of a circle area I in FIG. 5 from another perspective.
Figure 7:
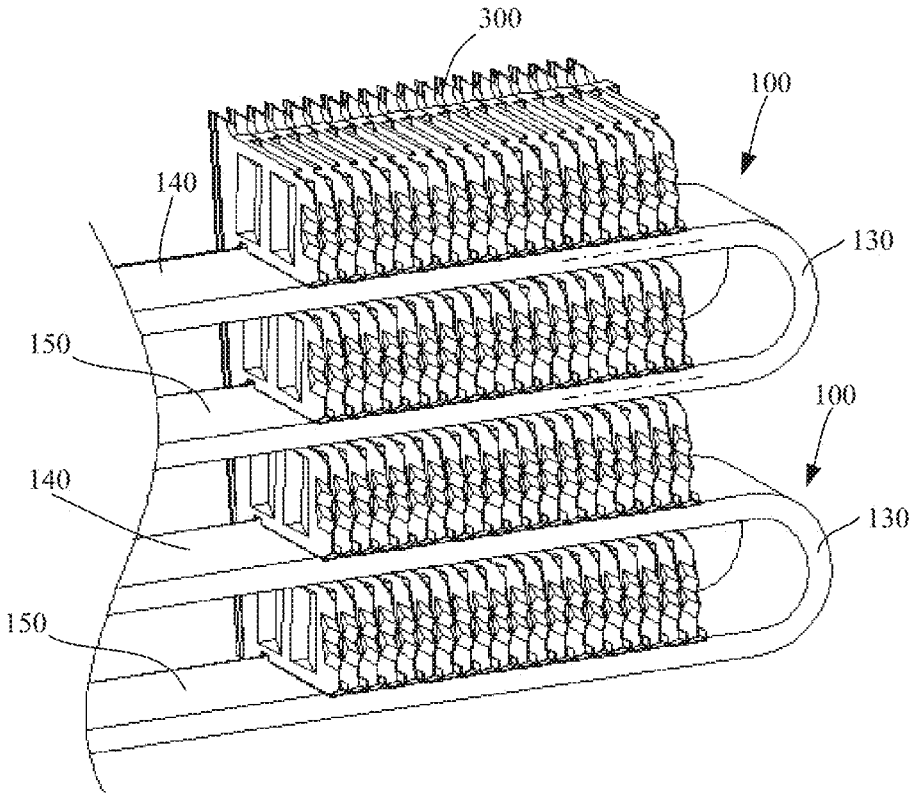
FIG. 7 is a diagram showing a partial structure of fins matched with flat pipes in a heat exchanger, in accordance with some embodiments.

FIG. 6 is a partial enlarged view of a circle area I in FIG. 5 from another perspective. FIG. 7 is a diagram showing a partial structure of fins matched with flat pipes in a heat exchanger in accordance with some embodiments.

In some embodiments, as shown in FIGS. 6 and 7, the plurality of flat pipes 100 in the first heat exchanger 30 and the plurality of flat pipes 100 in the second heat exchanger 40 are each bent into a "U" shape. The flat pipe 100 includes a first straight pipe section 140, a second straight pipe section 150, and a bent section 130. The first straight pipe section 140 and the second straight pipe section 150 are parallel to each other. The bent section 130 is located on the same side of the first straight pipe section 140 and the second straight pipe section 150, and an end of the first straight pipe section 140 and an end of the second straight pipe section 150 are connected by the bent section 130. Ends of the flat pipe 100 away from the bent section 130 have a first end 110 and a second end 120, another end of the first straight pipe section 140 is the first end 110 of the flat pipe 100, and another end of the second straight pipe section 150 is the second end 120 of the flat pipe 100.

In some embodiments, the heat exchanger 1 further includes first header(s) 200, a plurality of connectors 400, and a second header 500. The heat exchanger 1 includes a single first header 200; alternatively, the heat exchanger 1 includes a plurality of first headers 200.

The first header 200 is configured to evenly distribute the gas-liquid two-phase refrigerant into each flat pipe 100 in the first heat exchanger 30, and the first end 110 of each flat pipe 100 in the first heat exchanger 30 is connected to the first header 200.

Figure 11:
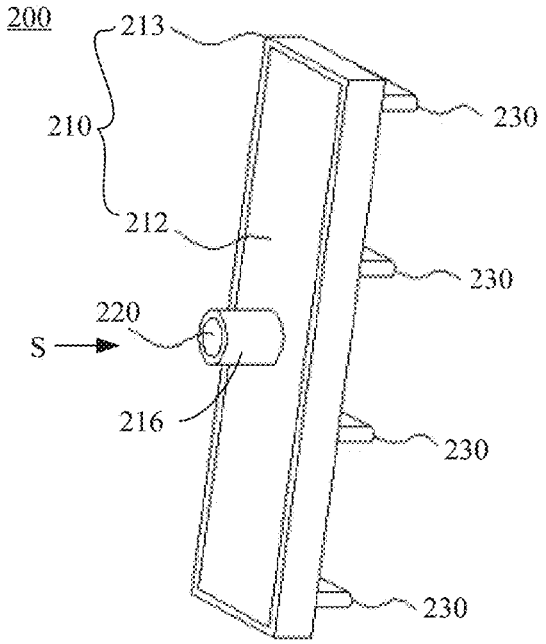
FIG. 11 is a three-dimensional view of a first header, in accordance with some embodiments.
Figure 12:
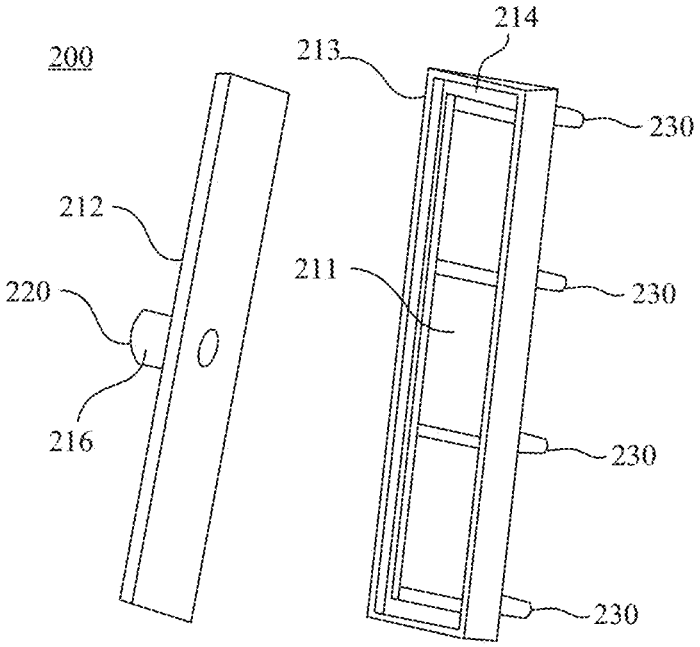
FIG. 12 is an exploded diagram of a first header, in accordance with some embodiments.
Figure 13:
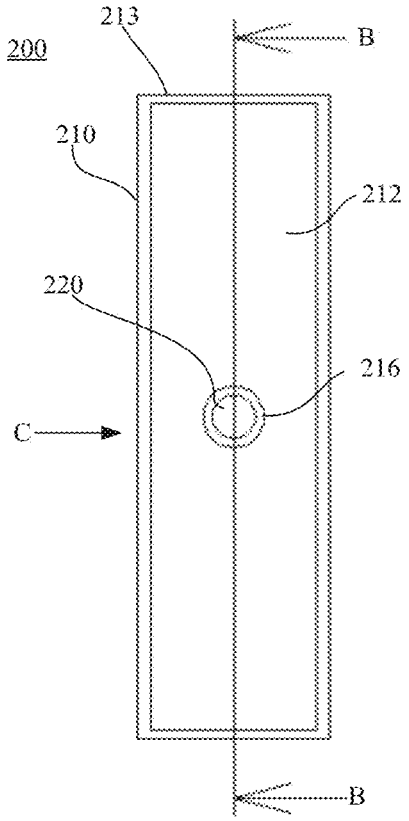
FIG. 13 is a front view in an S direction in FIG. 11.
Figure 14:
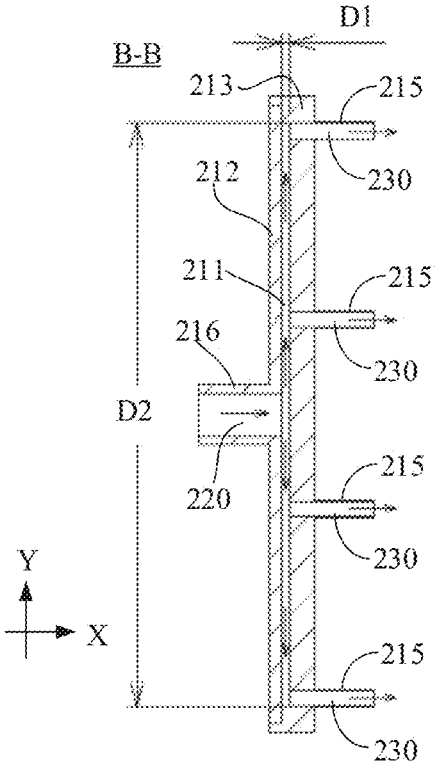
FIG. 14 is a cross-sectional view taken along a line B-B in FIG. 13.

FIG. 11 is a three-dimensional view of a first header in accordance with some embodiments. FIG. 12 is an exploded diagram of a first header in accordance with some embodiments. FIG. 13 is a front view in an S direction in FIG. 11. FIG. 14 is a cross-sectional view taken along a line B-B in FIG. 13.

In some embodiments, as shown in FIG. 11, the first header 200 includes a first header main body 210, a refrigerant inlet 220, and a plurality of refrigerant outlets 230.

As shown in FIGS. 12 and 14, the first header main body 210 has a hollow structure, and a flat flow channel 211 exists inside the first header main body 210. The flat flow channel 211 has a small depth D1 (referring to FIG. 14), and the flat flow channel 211 extends in the arrangement direction of the plurality of flat pipes 100 in the first heat exchanger 30. That is, the flat flow channel 211 extends in the Y direction shown in FIG. 5 or FIG. 14.

In some embodiments, as shown in FIGS. 11, 12, and 14, the first header main body 210 is in a shape of a rectangle, and a length direction of the first header main body 210 is consistent with an extension direction (i.e., a length direction) of the flat flow channel 211. The first header main body 210 includes an end cover portion 212 and a main body portion 213. An inner side wall of the main body portion 213 is provided with a positioning portion 214 matched with the end cover portion 212, and the end cover portion 212 is adapted to be embedded in the positioning portion 214 to be sealed and connected with the main body portion 213. After sealing connection, an outer surface of the end cover portion 212 is flush with an outer side edge of the main body portion 213, and the end cover portion 212 cooperates with the main body portion 213 to define the flat flow channel 211. For example, the positioning portion 214 is an annular groove.

It will be noted that the outer surface of the end cover portion 212 refers to a surface of the end cover portion 212 away from the flat pipe 100, and the outer side edge of the main body portion 213 refers to a circumference edge on a side of the main body portion 213 away from the flat pipe 100.

In some embodiments, as shown in FIG. 14, the refrigerant inlet 220 is disposed on a side of the end cover portion 212 away from the main body portion 213 and communicates with the flat flow channel 211. The plurality of refrigerant outlets 230 are disposed on a side of the main body portion 213 away from the end cover portion 212.

For example, as shown in FIG. 14, an inlet pipe 216 is provided on the side of the end cover portion 212 away from the main body portion 213. The inlet pipe 216 is integrally formed with the end cover portion 212, and the refrigerant inlet 220 is formed in the inlet pipe 216.

A plurality of outlet pipes 215 are further provided on the side of the main body portion 213 away from the end cover portion 212. The refrigerant outlet 230 is formed in the outlet pipe 215, and the outlet pipes 215 are connected to the flat pipes 100, respectively.

The plurality of refrigerant outlets 230 are spaced apart in the length direction (i.e., the Y direction) of the main body portion 213. The plurality of refrigerant outlets 230 are configured to be correspondingly connected to a plurality of flat pipes 100 in the first heat exchanger 30, so that the gas-liquid two-phase refrigerant evenly distributed by the first header 200 flows into corresponding flat pipes 100.

It can be understood that the high-speed gas-liquid two-phase refrigerant flows into the flat flow channel 211 from the refrigerant inlet 220. Since the flat flow channel 211 is a flat space, when a fluid of the gas-liquid two-phase refrigerant is in contact with a surface (i.e., a right side face of the flat flow channel 211 in the perspective of FIG. 14) of the flat flow channel 211 away from the refrigerant inlet 220 in the width direction of the flat flow channel 211, the fluid of the gas-liquid two-phase refrigerant will spread out quickly. Since the space of the flat flow channel 211 is small, the refrigerant may still maintain a high flow rate after spread out. The high flow rate may greatly suppress the influence of gravity, so that the gas-liquid two-phase refrigerant has no chance of generating gas-liquid phase separation. Therefore, the gas-liquid two-phase refrigerant flowing dispersedly around the refrigerant inlet 220 with the refrigerant inlet 220 as the center has almost the equal flow distribution, thereby flowing into each refrigerant outlet 230 uniformly.

Figure 15:
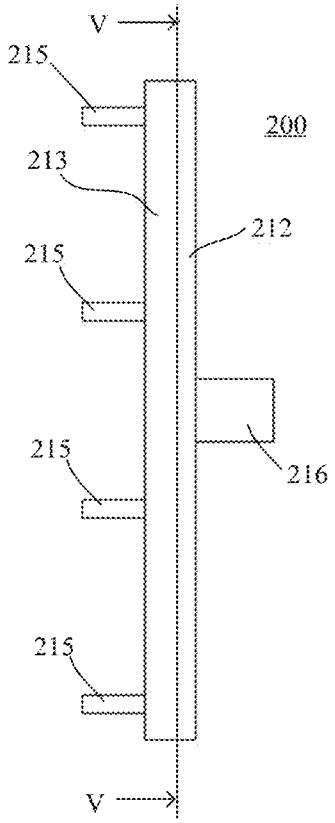
FIG. 15 is a front view in a C direction in FIG. 13.
Figure 16:
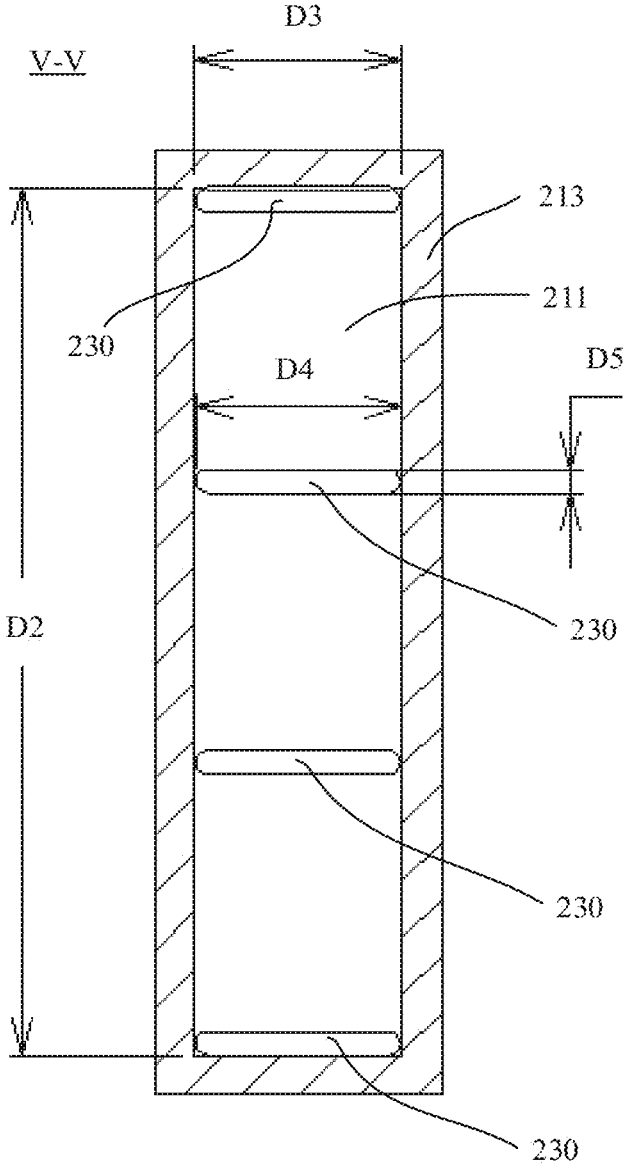
FIG. 16 is a cross-sectional view taken along a line V-V in FIG. 15.

FIG. 15 is a front view in a C direction in FIG. 13. FIG. 16 is a cross-sectional view taken along a line V-V in FIG. 15.

In some embodiments, as shown in FIGS. 14 and 16, the depth D1 of the flat flow channel 211 in a thickness direction (i.e., the X direction) of the first header main body 210 is in a range from 1 mm to 3 mm, a width D3 of the flat flow channel 211 in a width direction of the first header main body 210 is in a range from 10 mm to 22 mm, and a length D2 of the flat flow channel 211 in a length direction of the first header main body 210 is in a range from 50 mm to 100 mm.

For example, the depth D1 of the flat flow channel 211 may be 1 mm, 2 mm, or 3 mm, the width D3 of the flat flow channel 211 may be 10 mm, 15 mm, 18 mm, or 22 mm, and the length D2 of the flat flow channel 211 may be 50 mm, 70 mm, 90 mm, or 100 mm.

In some embodiments, as shown in FIG. 16, an orthographic projection of the refrigerant outlet 230 on the main body portion 213 is approximately in a shape of a rectangle, a length D4 of the rectangle is in a range of 10 mm to 22 mm, and a width D5 of the rectangle is in a range of 1.5 mm to 3 mm.

For example, the length D4 of the rectangle is 10 mm, 15 mm, 18 mm, or 22 mm, and the width D5 of the rectangle is 1.5 mm, 2.5 mm, or 3 mm.

In some embodiments, as shown in FIG. 16, a width direction of the orthographic projection (i.e., a width direction of the rectangle) of the refrigerant outlet 230 on the main body portion 213 is parallel to the extension direction of the flat flow channel 211, and a length direction thereof (i.e., a length direction of the rectangle) is parallel to the width direction of the flat flow channel 211 (i.e., a direction of the width D3). That is, the direction of the width D5 of the rectangle is parallel to the direction of the length D2 of the flat flow channel 211, and the direction of the length D4 of the rectangle is parallel to the direction of the width D3 of the flat flow channel 211. Therefore, by arranging the plurality of refrigerant outlets 230 in the extending direction of the flat flow channel 211, a length and a volume of the first header 200 may be reduced in a case where the number of the flat pipes 100 remains unchanged.

In addition, in order to prevent the refrigerant flowing at a high speed from directly entering the refrigerant outlet 230 directly opposite thereto after entering the flat flow channel 211 from the refrigerant inlet 220, which will affect the uniform tiling of the refrigerant, the refrigerant outlets 230 and the refrigerant inlet 220 may be disposed in a staggered manner (referring to FIG. 15). Moreover, refrigerant outlets 230 are respectively provided on both ends of the flat flow channel 211 in the extension direction thereof, so as to avoid presence of flow dead angles of the refrigerant at both ends of the flat flow channel 211 in the extension direction.

In some embodiments, as shown in FIGS. 13 and 14, the refrigerant inlet 220 is directly opposite to the center of the flat flow channel 211. That is, the refrigerant inlet 220 is disposed at a center position of the first header main body 210. As shown in FIG. 14, the plurality of refrigerant outlets 230 are arranged at equal intervals in the extension direction of the flat flow channel 211, so that the structure of the first header 200 may be symmetrical. Thus, it may not only realize fool-proofing, but also facilitate the even distribution of refrigerant.

In some embodiments, the heat exchanger 1 has a large volume and a high height. Therefore, the plurality of flat pipes 100 need to be provided. In this case, the heat exchanger 1 may include the plurality of first headers 200. The first header 200 includes a plurality of refrigerant outlets 230 for being connected with a plurality of flat pipes 100 in the first heat exchanger 30. In this way, it is possible to improve stability of the connection between the flat pipes 100 and the first header 200.

For example, the first header 200 includes four or six refrigerant outlets 230 for being connected with four or six flat pipes 100 in the first heat exchanger 30.

The plurality of connectors 400 are arranged corresponding to the plurality of flat pipes 100 in the first heat exchanger 30. The connector 400 is configured to make the flat pipes 100 in the first heat exchanger 30 communicate with the flat pipes 100 in the second heat exchanger 40. The second end 120 of the flat pipe 100 in the first heat exchanger 30 is connected to the connector 400, and the second end 120 of the flat pipe 100 in the second heat exchanger 40 is also connected to the connector 400. Therefore, the connector 400 may realize cross-row flow of the refrigerant between the first heat exchanger 30 and the second heat exchanger 40.

Figure 8:
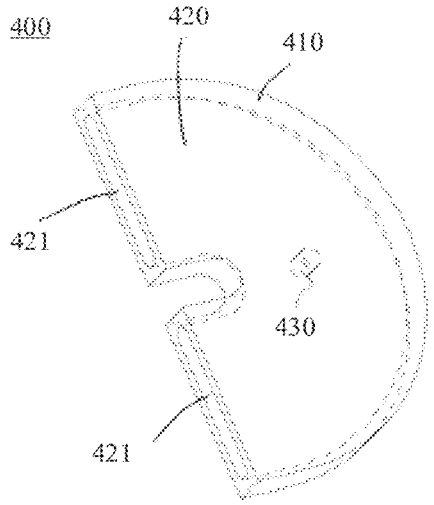
FIG. 8 is a three-dimensional view of a connector, in accordance with some embodiments.

FIG. 8 is a three-dimensional view of a connector in accordance with some embodiments.

For example, as shown in FIGS. 6 and 8, the connector 400 includes a housing 410 and a flow channel 420 formed in the housing 410. For example, the flow channel 420 is a flat communication flow channel. The flow channel 420 penetrates the housing 410 and has two openings 421. One of the two openings 421 communicates with a second end 120 of a flat pipe 100 in the first heat exchanger 30, and the other of the two openings 421 communicates with a second 120 of a flat pipe 100 in the second heat exchanger 40.

It will be noted that the cross-sectional size of each opening of the flow channel 420 matches the cross-sectional size of the flat pipe 100 communicated thereto.

In some embodiments, an increase in pressure of a refrigeration system (such as the aforementioned refrigerant loop) will lead to an increase in pressure in the connector 400. In order to prevent the connector 400 from being deformed due to insufficient pressure, as shown in FIG. 8, the connector 400 further includes a reinforcing rib 430, and the reinforcing rib 430 is disposed in the flow channel 420, so as to prevent the connector 400 from being deformed.

In some embodiments, the first end 110 of the flat pipe 100 in the first heat exchanger 30 is an inlet end of the refrigerant, and the second end 120 of the flat pipe 100 in the first heat exchanger 30 is an outlet end of the refrigerant. The second end 120 of the flat pipe 100 in the second heat exchanger 40 is an inlet end of the refrigerant, and the first end 110 of the flat pipe 100 in the second heat exchanger 40 is an outlet end of the refrigerant. The first ends 110 of the flat pipes 100 in the second heat exchanger 40 are connected to the second header 500.

The second header 500 is a pipe with both ends closed and hollow interior, and the second header 500 includes a plurality of connection openings. The plurality of connection openings are arranged in a pipe body of the second header 500, and the plurality of connection openings are respectively connected to first ends 110 of a plurality of flat pipes 100 in the second heat exchanger 40. The second header 500 is a gathering pipe of the whole refrigerant flowing out from the flat pipes 100. In a case where the air conditioner 1000 operates in the cooling mode, the second header 500 is connected to the compressor 22 to discharge gas, and the gaseous refrigerant with high-temperature and high-pressure may be evenly distributed from the plurality of connection openings of the second header 500 to the flat pipes 100 in the second heat exchanger 40.

It can be understood that in the heat exchanger 1, the flat pipes 100 in the second heat exchanger 40 and the flat pipes 100 in the first heat exchanger 30 are each U-shaped. Therefore, only a single second header 500 cooperated with first header(s) 200 is required for achieving the communication between the second heat exchanger 40 and the first heat exchanger 30 and the uniform distribution of the gas-liquid two-phase refrigerant, thereby simplifying the structure of the heat exchanger 1. In addition, since the first header 200 may evenly distribute the gas-liquid two-phase refrigerant into the flat pipes 100 in the first heat exchanger 30, compared with the use of the header 900 (as shown in FIG. 2 or FIG. 3) in the above embodiments, the interior of the second header 500 does not need to use partitions to divide the flow path, and thus the solder joints and refrigerant leakage points in the heat exchanger 1 may be reduced, and the structure and the manufacturing process of the heat exchanger 1 may be simplified.

It will be noted that the second header 500 extends through the whole heat exchanger 1 in the height direction (i.e., the Y direction shown in FIG. 5), and limited by its own frame structure, the heat exchanger 1 has no additional space for the second header 500 to be directly connected to the compressor 22. Therefore, in some embodiments, the heat exchanger 1 further includes a main air pipe assembly 600. The main air pipe assembly 600 serves as a transitional connection pipe between the compressor 22 and the heat exchanger 1 and is configured to realize the connection between the second header 500 and the compressor 22.

Figure 9:
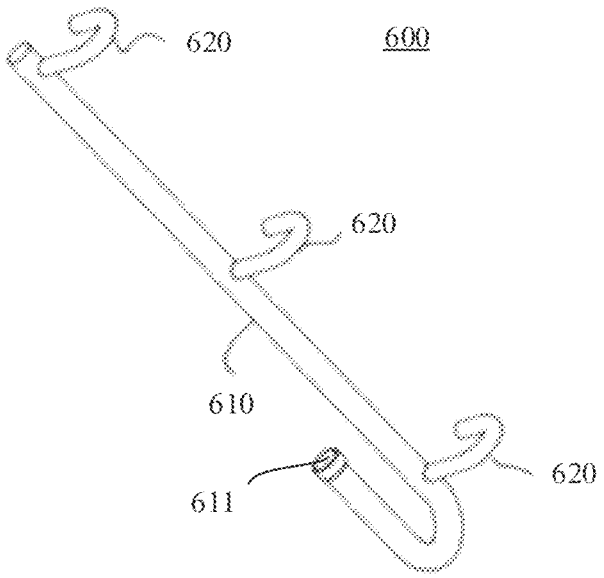
FIG. 9 is a three-dimensional view of a main air pipe assembly, in accordance with some embodiments.

FIG. 9 is a three-dimensional view of a main air pipe assembly in accordance with some embodiments.

In some embodiments, as shown in FIG. 9, the main air pipe assembly 600 includes a main air pipe 610, a plurality of branch air pipes 620, and a connecting pipe 611. An end of a branch air pipe 620 directly communicates with the main air pipe 610, and another end of the branch air pipe 620 communicates with the second header 500. The plurality of branch air pipes 620 are arranged at intervals in an extending direction (i.e., a length direction) of the main air pipe 610. The extending direction of the main air pipe 610 is substantially the same as the extending direction of the second header 500. An end of the main air pipe 610 is closed, and another end of the main air pipe 610 communicates with the connecting pipe 611. The connecting pipe 611 is configured to connect the main air pipe 610 to the compressor 22. In this way, the second header 500 and the compressor 22 may be connected by the main air pipe assembly 600.

In some embodiments, limited by its own frame structure, the heat exchanger 1 has no additional space for the first header 200 to be directly connected to the throttle mechanism 25. Therefore, in some embodiments, the heat exchanger 1 further includes a liquid pipe assembly 700. The liquid pipe assembly 700 serves as a transitional connection pipe assembly between the throttle mechanism 25 and the heat exchanger 1 and is configured to realize the connection between the throttle mechanism 25 and the first header 200.

Figure 10:
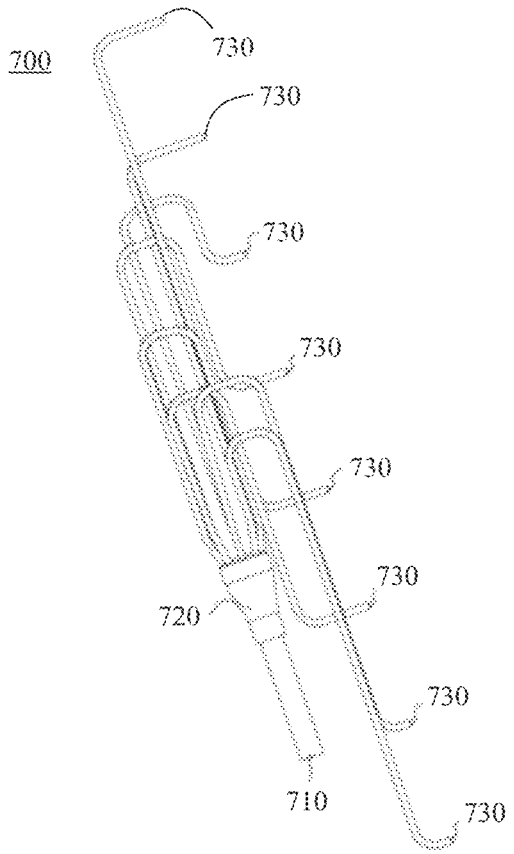
FIG. 10 is a structural diagram of a liquid pipe assembly, in accordance with some embodiments.

FIG. 10 is a structural diagram of a liquid pipe assembly in accordance with some embodiments. For example, as shown in FIG. 10, the liquid pipe assembly 700 includes a main liquid pipe 710, a flow dividing portion 720, and a plurality of branch liquid pipes 730. An end of the main liquid pipe 710 communicates with the throttle mechanism 25, and another end of the main liquid pipe 710 is connected with the flow dividing portion 720. The inlet ends of the plurality of branch liquid pipes 730 are each connected to the flow dividing portion 720, and the outlet ends of the plurality of branch liquid pipes 730 are respectively connected to the refrigerant inlets 220 of the plurality of first headers 200.

In some embodiments, in a case where the air conditioner 1000 operates in the heating mode, the refrigerant becomes a gas-liquid two-phase refrigerant with low-temperature and low-pressure after being throttled by the throttle mechanism 25 in the refrigeration system. When the gas-liquid two-phase refrigerant enters the liquid pipe assembly 700, due to a small cross-sectional area of a flow channel in the branch liquid pipe 730, it is difficult to generate gas-liquid separation. Therefore, the gas-liquid two-phase refrigerant may uniformly pass through each branch liquid pipe 730 to enter a corresponding first header 200 and are evenly distributed by the first header 200 to flat pipes 100 in the first heat exchanger 30.

The gas-liquid two-phase refrigerant flows, in the flat pipe 100 in the first heat exchanger 30, from a flow dividing side of the heat exchanger 1 (e.g., a side of the heat exchanger 1 provided with the first header 200) to a tail side (e.g., a side where the bending section 130 of the flat pipe 100 is located), and passes through the bending section 130 at the tail side and flows to the flow dividing side again. After reaching the flow dividing side again, the gas-liquid two-phase refrigerant may flow into the flat pipe 100 in the second heat exchanger 40 through the connector 400.

Similarly, the gas-liquid two-phase refrigerant flows, in the flat pipe 100 in the second heat exchanger 40, from the flow dividing side of the heat exchanger 1 to the tail side, passes through the bending section 130 of the flat pipe 100 at the tail side of the heat exchanger 1 and returns again, and flows into the second header 500 from the first end 110 of the flat pipe 100 in the second heat exchanger 40 and further into the main air pipe assembly 600. Then, the gas-liquid two-phase refrigerant flows into the suction end of the compressor 22 in the refrigeration system through the main air pipe assembly 600, so as to complete a heating process.

As the refrigerant starts to flow from the first end 110 of the flat pipe 100 in the first heat exchanger 30, the refrigerant continuously absorbs heat. As the flow proceeds, the refrigerant gradually vaporizes and the dryness degree increases continuously. When reaching the outlet of the main air pipe assembly 600, the refrigerant will be heated into a superheated gas.

In some embodiments, in a case where the air conditioner 1000 operates in the cooling mode, the compressor 22 discharges superheated gaseous refrigerant with high-temperature and high-pressure into the main air pipe assembly 600. In this case, since the refrigerant is in a gaseous state, the pressure distribution is relatively uniform, and thus the refrigerant may be evenly distributed into each branch air pipe 620, and further evenly distributed into the second header 500. In the second header 500, the state of the refrigerant remains unchanged. Therefore, the refrigerant is evenly distributed to the flat pipes 100 in each second heat exchanger 40. In this case, the refrigerant will flow in an opposite process as the operation in the heating mode of the air conditioner 1000 and exchange heat with the air to be gradually cooled by the air to a supercooled liquid. In the case where the air conditioner 1000 operates in the cooling mode, the refrigerant is mostly gas with high-temperature and high-pressure, so the distribution of the refrigerant is relatively uniform.

Figure 17:
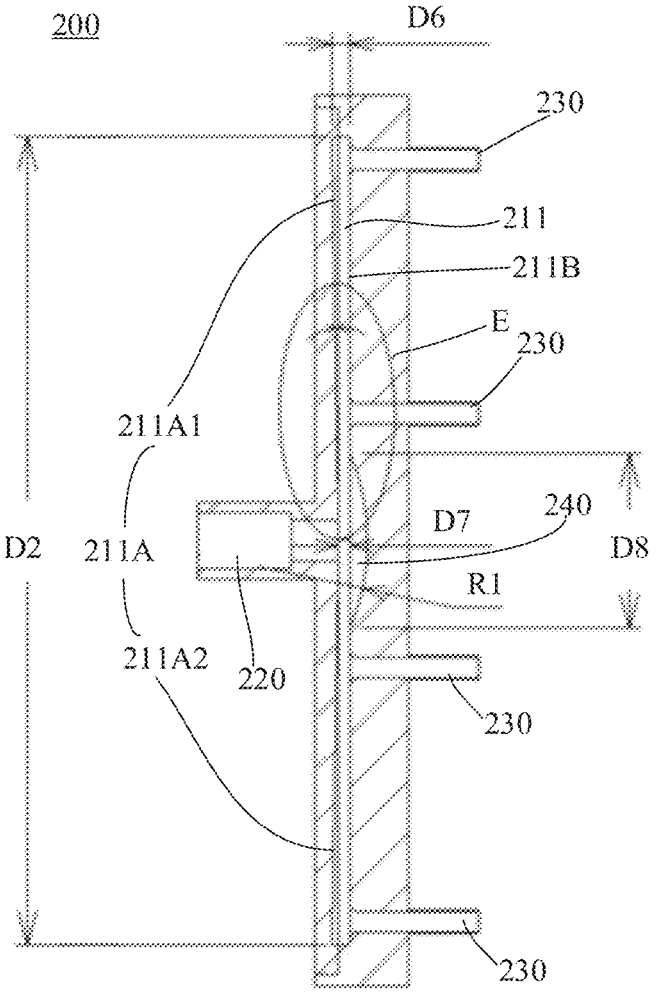
FIG. 17 is a sectional view of another first header, in accordance with some embodiments.

FIG. 17 is a sectional view of another first header in accordance with some embodiments.

In some embodiments, as shown in FIG. 17, the flat flow channel 211 in the first header 200 includes a first side face 211A and a second side face 211B. The first side face 211A and the second side face 211B are two opposite side faces of the flat flow channel 211 in the depth direction, and the first side face 211A is closer to the refrigerant inlet 220 than the second side face 211B.

The main difference between FIG. 17 and FIG. 14 is that, along the extending direction of the flat flow channel 211, the first side face 211A includes a first side sub-face 211A1 and a second side sub-face 211A2. The first side sub-face 211A1 and the second side sub-face 211A2 are symmetrical about the refrigerant inlet 220, and the first side sub-face 211A1 and the second side sub-face 211A2 are each inclined in a direction from a side away from the refrigerant inlet 220 to a side proximate to the refrigerant inlet 220. That is, a distance between the side away from the refrigerant inlet 220 and the second side face 211B is greater than a distance between the side proximate to the refrigerant inlet 220 and the second side face 211B.

It will be noted that when the high-speed gas-liquid two-phase refrigerant flows into the flat flow channel 211 through the refrigerant inlet 220 and is in contact with the second side face 211B, the flow direction of the refrigerant turns by 90°, and the refrigerant flows in a tiling manner in all directions. This will cause a significant pressure loss in the heat exchanger 1 and cause flash evaporation of the refrigerant, so that the gas phase ratio of the refrigerant increases, and further aggravate the pressure loss. As a result, the refrigeration performance of the air conditioner 1000 may be affected.

In order to avoid the occurrence of the above situation, in some embodiments, the first side sub-face 211A1 and the second side sub-face 211A2 of the flat flow channel 211 are each inclined in the direction from the side away from the refrigerant inlet 220 to the side proximate to the refrigerant inlet 220, so that the flow cross-sectional area of the flat flow channel 211 changes. In this way, when the refrigerant enters the flat flow channel 211 from the refrigerant inlet 220 and flows in all directions, the flow cross-sectional area of the refrigerant increases continuously, and thus the on-way resistance in the flow direction of the refrigerant may be balanced, so that the amount of the refrigerant flowing through the refrigerant outlets 230 at both ends of the flat flow channel 211 in the extension direction thereof is substantially equal to the amount of the refrigerant passing through the refrigerant outlets 230 proximate to the refrigerant inlet 220.

Figure 19:
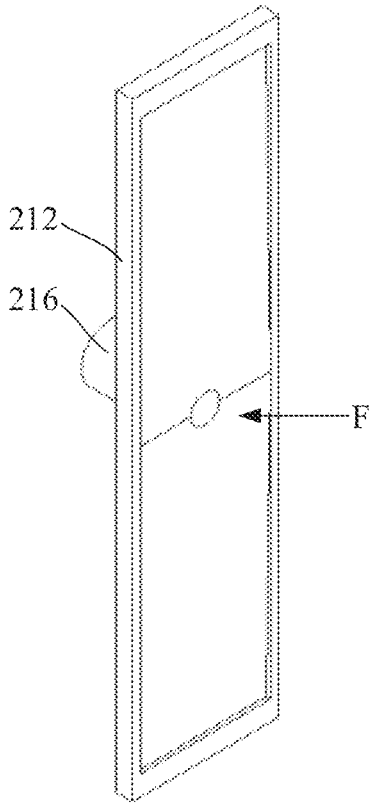
FIG. 19 is a three-dimensional view of an end cover portion of another first header, in accordance with some embodiments.
Figure 20:
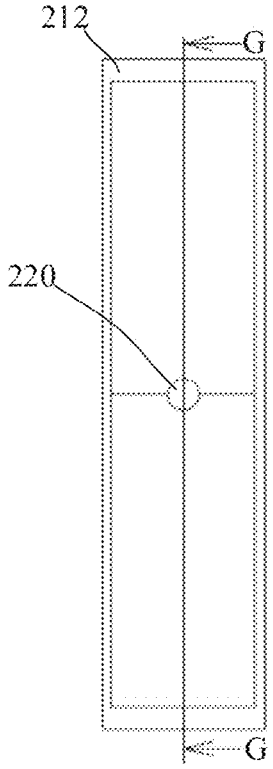
FIG. 20 is a front view in an F direction of an end cover portion of a first header in FIG. 19.
Figure 21:
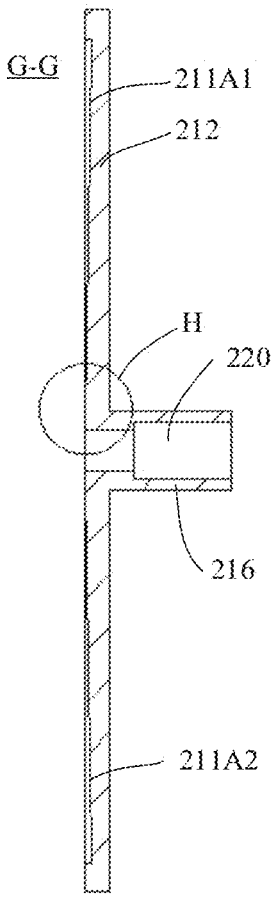
FIG. 21 is a cross-sectional view taken along a line G-G in FIG. 20.

FIG. 19 is a three-dimensional view of an end cover portion of another first header in accordance with some embodiments. FIG. 20 is a front view in an F direction of an end cover portion of a first header in FIG. 19. FIG. 21 is a cross-sectional view taken along a line G-G in FIG. 20.

In some embodiments, as shown in FIGS. 19 to 21, the end cover portion 212 of the first header 200 may be partially thinned to form the flat flow channel 211 in the first header 200.

For example, a center of the end cover portion 212 is not thinned, but the end cover portion 212 is thinned along the center of the end cover portion 212 towards both ends in a length direction thereof. That is, a surface on a side of the end cover portion 212 away from the refrigerant inlet 220 is inclined in a direction from a side proximate to the second side face 211B to a side away from the second side face 211B. In this way, the flat flow channel 211 with changed cross-section may be formed by the cooperation of the end cover portion 212 and the main body portion 213, and the structure of the main body portion 213 is simple, which is convenient for processing and assembly.

Figure 22:
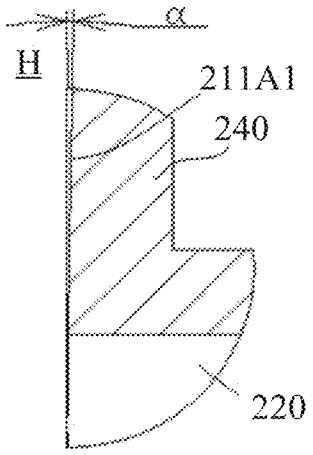
FIG. 22 is a partial enlarged view of a circle area H in FIG. 21.

FIG. 22 is a partial enlarged view of a circle area H in FIG. 21.

In some embodiments, as shown in FIGS. 17 and 22, after the end cover portion 212 and the main body portion 213 are assembled, a minimum depth of the flat flow channel 211 is D7, a maximum depth of the flat flow channel 211 is D6, and a total extension length of the flat flow channel 211 is D2. The inclination angle of each of the first side sub-face 211A1 and the second side sub-face 211A2 is a. Therefore, there is a relationship of $\alpha$=arctan 2(D6−D7)/D2, where the angle $\alpha$ is in a range of 0.7° to 2°. For example, the angle $\alpha$ may be 0.7°, 1.0°, 1.5°, 2°, or the like.

In some embodiments, as shown in FIGS. 14 and 15, for convenience of processing, an axis of the refrigerant inlet 220 and an axis of the refrigerant outlet 230 are each perpendicular to the second side face 211B.

Figure 23:
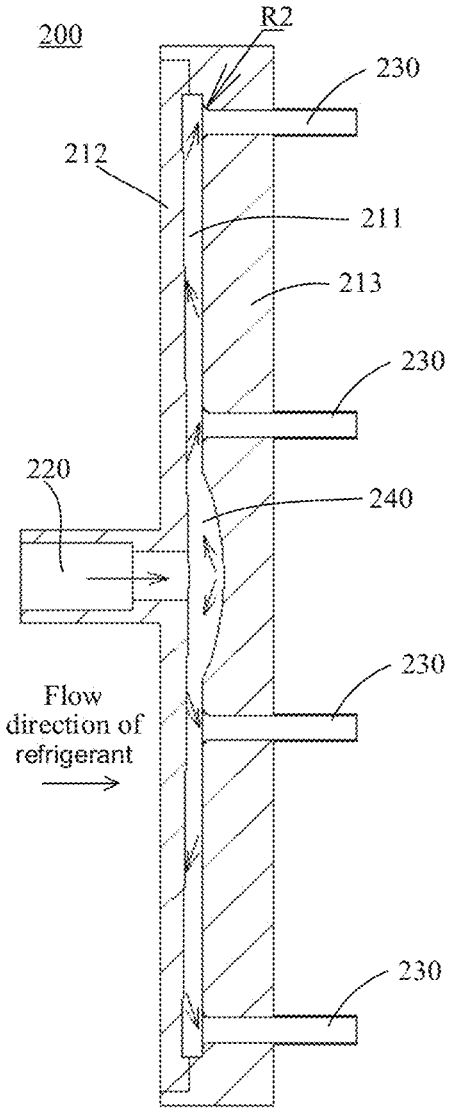
FIG. 23 is a cross-sectional view of yet another first header, in accordance with some embodiments.

FIG. 23 is a cross-sectional view of yet another first header in accordance with some embodiments.

In some embodiments, as shown in FIGS. 17 and 23, a buffer portion 240 is provided at a position, opposite to the refrigerant inlet 220, of the second side face 211B of the flat flow channel 211. The buffer portion 240 is recessed towards a direction away from the first side face 211A. The longitudinal section of the buffer portion 240 is in a shape of a circular arc, a chord length is D8, and a radius of a circle where the circular arc is located is R1.

The buffer portion 240 may make the high-speed refrigerant disperse having entered the refrigerant inlet 220 rather evenly. Moreover, the concave curved surface of the buffer portion 240 provided on the main body portion 213 may effectively buffer the refrigerant entering the flat flow channel 211, which is conducive to reduce of pressure loss and may make the refrigerant spread out quickly. The concave curved surface of the buffer portion 240 provided on the main body portion 213 may also make the refrigerant flow in a varying direction in the flat flow channel 211, which is conducive to the mixing of the refrigerant and may further reduce the possibility of the gas-liquid separation of the refrigerant. The flow direction of the refrigerant in the flat flow channel 211 may refer to the pointing directions of arrows in FIG. 23.

Figure 18:
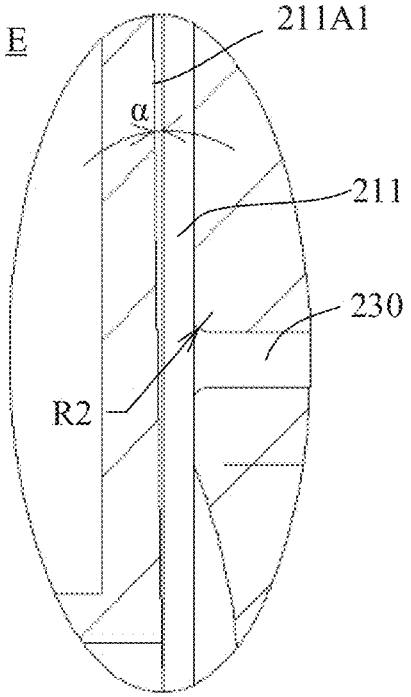
FIG. 18 is a partial enlarged view of a circle area E in FIG. 17.

FIG. 18 is a partial enlarged view of a circle area E in FIG. 17.

In some embodiments, in order to reduce the flow resistance caused by the eddy flow inside the flat pipe 100, as shown in FIGS. 17, 18 and 23, the refrigerant outlet 230 and the flat flow channel 211 have transition rounded corners at connection positions therebetween. That is, an inlet end of the refrigerant outlet 230 is provided with rounded corners, and a radius R2 of a rounded corner is in a range of 0.5 mm to 2 mm. For example, the radius R2 may be 0.5 mm, 1.0 mm, 1.5 mm, or 2 mm.

The foregoing descriptions are merely specific implementations of the present disclosure, but the protection scope of the present disclosure is not limited thereto. Changes or replacements that any person skilled in the art could conceive of within the technical scope of the present disclosure shall be included in the protection scope of the present disclosure. Therefore, the protection scope of the present disclosure shall be subject to the protection scope of the claims.

It will be appreciated by those skilled in the art that the scope of disclosure involved in the present disclosure is not limited to technical solutions formed by particular combinations of the above technical features, but shall also encompass other technical solutions formed by any combination of the above technical features or equivalents thereof without departing from the concept of present disclosure, for example, the technical solutions formed by replacing the above features with technical features having similar functions disclosed in some embodiments (but not limited thereto).

What is claimed is:

1. An air conditioner, comprising:

a compressor; and a heat exchanger, including:

a first heat exchanger including a plurality of flat pipes;

a second heat exchanger including another plurality of flat pipes, wherein the another plurality of flat pipes in the second heat exchanger correspond to the plurality of flat pipes in the first heat exchanger, and each flat pipe in both the another plurality of flat pipes in the second heat exchanger and the plurality of flat pipes in the first heat exchanger includes:

a first straight pipe section;

a second straight pipe section parallel to the first straight pipe section; and a bent section located on a same side of the first straight pipe section and the second straight pipe section and connected to an end of the first straight pipe section and an end of the second straight pipe section; another end of the first straight pipe section being a first end of the flat pipe, and another end of the second straight pipe section being a second end of the flat pipe;

a plurality of connectors disposed corresponding to the plurality of flat pipes in the first heat exchanger, any connector in the plurality of connectors being configured to make a second end of a flat pipe in the first heat exchanger connected to a second end of a flat pipe in the second heat exchanger;

at least one first header connected to first ends of the plurality of flat pipes in the first heat exchanger;

a second header connected to first ends of the another plurality of flat pipes in the second heat exchanger; and a main air pipe assembly, including:

a main air pipe with an end closed;

a plurality of branch air pipes arranged at intervals in an extending direction of the main air pipe, an end of any branch air pipe in the plurality of branch air pipes communicating with the main air pipe, and another end thereof communicating with the second header; and a connecting pipe, another end of the main air pipe being connected to an end of the connecting pipe, and another end of the connecting pipe being connected to the compressor.

2. The air conditioner according to claim 1, wherein any first header in the at least one first header includes:

a first header main body including an end cover portion and a main body portion, the end cover portion and the main body portion cooperating to define a flat flow channel;

a refrigerant inlet disposed on a side of the end cover portion away from the main body portion and communicating with the flat flow channel; and a plurality of refrigerant outlets disposed on a side of the main body portion away from the end cover portion and being spaced apart in a length direction of the main body portion, the plurality of refrigerant outlets communicating with the flat flow channel, wherein refrigerant outlets of the at least one first header are respectively connected to the first ends of the plurality of flat pipes in the first heat exchanger.

3. The air conditioner according to claim 2, wherein the flat flow channel has a first side face and a second side face, the first side face and the second side face are disposed oppositely in a depth direction of the flat flow channel, and the first side face is closer to the refrigerant inlet than the second side face;

the first header main body further includes a buffer portion; the buffer portion is located at a position of the second side face opposite to the refrigerant inlet, and is recessed towards a direction away from the first side face.

4. The air conditioner according to claim 3, wherein in a length direction of the flat flow channel, the first side face includes a first side sub-face and a second side sub-face; the first side sub-face and the second side sub-face are symmetrical about the refrigerant inlet, and the first side sub-face and the second side sub-face are each inclined in a direction from a side away from the refrigerant inlet to a side proximate to the refrigerant inlet in the length direction of the flat flow channel.

5. The air conditioner according to claim 2, wherein an orthographic projection of a refrigerant outlet on the main body portion is substantially in a shape of a rectangle; a width direction of the rectangle is parallel to a length direction of the flat flow channel, and a length direction of the rectangle is parallel to a width direction of the flat flow channel.

6. The air conditioner according to claim 5, wherein the plurality of refrigerant outlets and the refrigerant inlet in the any first header are disposed in a staggered manner, and both ends of the flat flow channel in the length direction thereof are each provided a refrigerant outlet in the plurality of refrigerant outlets.

7. The air conditioner according to claim 6, wherein the refrigerant inlet is located at a center of the end cover portion, and the plurality of refrigerant outlets are disposed at equal intervals in the length direction of the flat flow channel.

8. The air conditioner according to claim 7, wherein an axis of the refrigerant inlet and axes of the plurality of refrigerant outlets are each parallel to a thickness direction of the first header main body.

9. The air conditioner according to claim 5, wherein a length of the rectangle is in a range of 10 mm to 22 mm, inclusive, and a width of the rectangle is in a range of 1.5 mm to 3 mm, inclusive.

10. The air conditioner according to claim 2, wherein the at least one first header includes a plurality of first headers, any first header in the plurality of first headers includes a plurality of refrigerant outlets, and the plurality of refrigerant outlets are connected to flat pipes in the first heat exchanger, respectively.

11. The air conditioner according to claim 2, wherein in a length direction of the flat flow channel, a depth of the flat flow channel in a middle thereof is equal to a depth of the flat flow channel at both ends thereof; or in the length direction of the flat flow channel, the depth of the flat flow channel in the middle thereof is smaller than the depth of the flat flow channel at the both ends thereof.

12. The air conditioner according to claim 2, wherein a depth of the flat flow channel in a thickness direction of the first header main body is in a range of 1 mm to 3 mm, inclusive;

a width of the flat flow channel in a width direction of the first header main body is in a range of 10 mm to 22 mm, inclusive; and a length of the flat flow channel in a length direction of the first header main body is in a range of 50 mm to 100 mm, inclusive.

13. The air conditioner according to claim 2, wherein the refrigerant outlet and the flat flow channel have a transition rounded corner at a connection position therebetween.

14. The air conditioner according to claim 1, wherein the plurality of connectors include:

a housing; and a flow channel provided in the housing and including two openings, wherein one of the two openings communicates with the second end of the flat pipe in the first heat exchanger, and another of the two openings communicates with the second end of the flat pipe in the second heat exchanger.

15. The air conditioner according to claim 14, wherein a cross-sectional size of each opening of the flow channel matches a cross-sectional size of a flat pipe communicated thereto.

16. The air conditioner according to claim 14, wherein the plurality of connectors further include a reinforcing rib disposed inside the flow channel.

17. The air conditioner according to claim 2, further comprising a throttle mechanism, wherein the at least one first header includes a plurality of first headers; the heat exchanger further includes a liquid pipe assembly, and the liquid pipe assembly is configured to make the plurality of first headers connected with the throttle mechanism.

18. The air conditioner according to claim 17, wherein the liquid pipe assembly includes:

a main liquid pipe, an end of the main liquid pipe being connected to the throttle mechanism;

a flow dividing portion, another end of the main liquid pipe being connected to the flow dividing portion; and a plurality of branch liquid pipes, inlet ends of the plurality of branch liquid pipes being each connected to the flow dividing portion, and outlet ends of the plurality of branch liquid pipes being respectively connected to refrigerant inlets of the plurality of first headers.

* * * * *